US007141926B2

(12) United States Patent
Tomasetti et al.

(10) Patent No.: US 7,141,926 B2
(45) Date of Patent: Nov. 28, 2006

(54) PHOTOMULTIPLIER TUBE WITH IMPROVED LIGHT COLLECTION

(75) Inventors: Charles M. Tomasetti, Leola, PA (US); Scott C. Moulzolf, Lancaster, PA (US)

(73) Assignee: Burle Technologies, Inc., Wilmington, DE (US)

( * ) Notice: Subject to any disclaimer, the term of this patent is extended or adjusted under 35 U.S.C. 154(b) by 75 days.

(21) Appl. No.: 10/915,622

(22) Filed: Aug. 10, 2004

(65) Prior Publication Data

US 2006/0033432 A1 Feb. 16, 2006

(51) Int. Cl.
*H01J 43/04* (2006.01)

(52) U.S. Cl. ..... 313/532; 250/214 VT; 313/103 R; 313/104

(58) Field of Classification Search ..... 313/103 R, 313/532–536, 105 R, 538, 525, 103 CM, 313/104, 105 CM, 540, 537; 250/366, 207, 250/214 VT
See application file for complete search history.

(56) References Cited

U.S. PATENT DOCUMENTS 4,107,534 A 8/1978 Piltingsrud
4,306,171 A * 12/1981 Faulkner et al. ..... 313/533
5,442,179 A * 8/1995 Ohishi ..... 250/363.02
6,946,641 B1 * 9/2005 Shimoi et al. ..... 250/214 VT
2002/0163641 A1 11/2002 Shroder

FOREIGN PATENT DOCUMENTS

EP 1282150 2/2003
JP 55-71969 * 5/1980

* cited by examiner

*Primary Examiner*—Allen C. Ho
(74) *Attorney, Agent, or Firm*—Dann, Dorfman, Herrell and Skillman, P.C.

(57) ABSTRACT

Photomultiplier tubes with improved collection of incident radiation, especially from the periphery of the front face of the tube, and that more efficiently couple the collected radiation to the photocathode, and moreover have higher packing densities when assembled into arrays, resulting in enhanced imaging characteristics. The improvements in radiation collection and photomultiplier tube packing density are gained by a combination of several features including: tapering the edges of the faceplate so that the faceplate subtends an area as large or larger than any other cross-sectional area of the photomultiplier tube; forming the junction between the faceplate and metal tube on the underside of the faceplate, and in such a manner as to avoid obscuring the optical path between the incident radiation and photocathode; and utilizing the tapered edge of the faceplate as a reflector to couple radiation incident on the periphery of the faceplate to the photocathode.

12 Claims, 10 Drawing Sheets

Prior Art

PHOTOMULTIPLIER TUBE WITH IMPROVED LIGHT COLLECTION

FIELD OF INVENTION

This invention relates to electronic vacuum tube devices for detecting and measuring radiation, and their use in imaging applications. In particular, the present invention pertains to photomultiplier tubes that generate amplified electric signals in response to incident radiation. More specifically, the invention relates to photomultiplier tube designs and methods of fabrication that improve their light collection efficiency, spatial response, and packing density; and thereby enhance their utility in detector and imaging arrays.

BACKGROUND OF THE INVENTION

As their name implies, photomultiplier tubes are fashioned in some approximation of a tubular shape. In one common embodiment, the photomultiplier is comprised of a metal tube, the longitudinal centerline of which defines the axis of the device. In head-on type photomultiplier tubes, there is a transparent faceplate at one end of the tube that admits light or other radiation into the tube. The other end of the tube is closed with a stemplate, through which air-tight connections to various internal electrodes are made. The tube may be of circular, rectangular, or hexagonal cross-section. Rectangular or hexagonal tube cross-sections are useful when several or more photomultiplier tubes are arranged side-by-side in close proximity and a high packing density is desired.

FIG. 1 is a side-view schematic of a generic photomultiplier tube of the head-on type and of the kind wherein a metal tubular element, rather than a glass envelope, delimits the cross-sectional area of the vacuum enclosure of the device. FIG. 1 is meant simply to convey the overall structure and general features of head-on type metal-tube photomultipliers, but is non-specific about the details of the junction formed between the metal tube and glass faceplate, which is a subject of the present invention. The generic features of such a photomultiplier tube include a metal tube (102), closed at one end by a glass faceplate (104), and sealed at the opposite end by a metal stemplate (106). Electrode connections (108) are made through the stemplate. A framework or cage of electrodes (110), including various dynodes or microchannel plate(s), and anode(s) are mounted in the enclosure so formed. One electrode functions as a photocathode that upon absorption of photons emits electrons. These photoelectrons emitted from the photocathode are accelerated toward a nearby electrode by an electric field imposed between the cathode and electrode. The photocathode may be a separate electrode with a photoemissive coating, or commonly, the photocathode may be realized as a coating of photoemissive material (112) deposited on the inside surface of the faceplate. The dynodes or microchannel plates are electrically biased such that impact of an electron causes emission of several or more secondary electrons. Incident radiation (114) is transmitted through the faceplate (104) and is absorbed by the photocathode (112) to initiate the cascade of electrons that ultimately generates an anode current. The dynodes or microchannel plates provide an electron multiplication effect that is the basis of the high signal gain characteristic of photomultiplier tubes. The anode current output response to incident light depends on many factors related to the optical path of incident light and the trajectories of photoelectrons and secondary electrons. Ideally, the anode current response is independent of the position of incident light on the front face of the photomultiplier tube. However, in photomultiplier tubes constructed as shown in FIG. 1, a peripheral region (116) around the edge of the faceplate (104) that exhibits a reduced or distorted response to incident light is evident. Compared to the anode current resulting from photons incident on the center of the faceplate (104), the anode currents resulting from radiation incident upon the edge regions (116) of the photomultiplier tube front face are diminished or otherwise perturbed from the response of the central portion of the tube due to obscuration of the photocathode, non-uniformities in the optical path between the exterior side of the faceplate and the photocathode, and fringe effects in the electron multiplication cascade provided by the other electrodes. The situation is further complicated in that often the incident light is of a diffuse nature and is obliquely incident on the faceplate, resulting in multiple internal reflections within the glass faceplate or tube enclosure. This is especially true if the light is generated by a scintillator material in close proximity to the faceplate, in which case the incident radiation can be approximately isotropic, and a significant portion of the radiation will be trapped by optical confinement in the faceplate. As will be discussed with respect to the present invention, these light trapping effects can be exploited to ameliorate deficiencies in the response characteristics associated with the edge regions of the photomultiplier tube.

The spatially non-uniform anode currents associated with such edge effects create gaps or distortions in the position-dependent response characteristics of photomultiplier tubes. These edge effects, regardless of their origin or the relative contributions of various structural features and phenomena, complicate the use of such photomultiplier tubes when they are grouped together side-by-side in an imaging or detector array. The present invention seeks to address these shortcomings by utilizing a design and method of fabrication that avoids or compensates for these edge effects, particularly with regard to edge shape of the glass faceplate and the manner in which it is attached to the metal tube. The contact and sealing between the glass faceplate (104) and the metal tube (102) can be made in several ways, and is an aspect of the present invention.

In some cases, instead of a faceplate, a glass envelope of hemispherical shape, or of hexagonal or rectangular cross section with a flat top, is used. FIG. 2A shows a side view and FIG. 2B shows a perspective view of a photomultiplier tube having such a glass envelope (202) that is aligned and sealed to a metal tube (204) with the opposite end closed by a stemplate (206), similar to the photomultiplier tube of FIG. 1. A photocathode (208) can be formed as coating on the inside surface of the glass envelope. Still, in such photomultiplier designs as depicted in FIG. 2, the finite wall (210) thickness of the glass envelope is the source of an edge effect, in that radiation incident at the perimeter of the envelope is not efficiently transmitted to the photocathode. Such edge effects are inherent to some degree in practically all photomultiplier tubes, thus making their use in arrays problematic.

The reduced or distorted response of the peripheral regions of a photomultiplier tube has important consequences when a number of photomultiplier tubes are assembled in a close-packed configuration as part of an array for imaging applications. FIG. 3A shows a top plan-view of the front faces of several circular-cross section photomultiplier tubes (302) in such an array (304). The maximum packing density is evidently determined by the points of contact, e.g., (306), between the metal tubes (or the glass envelope sidewalls) of adjacent photomultipliers. In imaging or detector arrays utilizing standard photomultiplier tubes, the total photosensitive area of the array, as determined by the sum of the photosensitive areas (308) of the component photomultiplier tubes (302), is less than the nominal total area of the array itself. In particular, there are gaps (310) between adjacent photomultiplier tubes (302) upon which incident radiation will not be detected, or for which the response will be substantially reduced or distorted compared to the response for light incident on central regions of the photomultiplier tube faceplate. As an example, a schematic plot of response as a function of the position of incident radiation on the front face of the photomultiplier tube is shown in FIG. 3B for a section A–A' of FIG. 3A. The vertical axis is the localized response. Such a plot can be understood as the result of scanning a finely focused light beam probe, such as produced by a laser, across the front face of the photomultiplier tubes of the array and for which the anode current response is recorded as a function of the position of the light beam probe along a path such as section A–A'. The dips in the response curve of FIG. 3B correspond to the reduced response associated with light incident at the periphery of photomultiplier tubes or at the intervening space between adjacent photomultiplier tubes.

Edge effects and their consequent diminished or distorted response are not limited to photomultiplier tubes of circular cross section. Photomultiplier tubes of rectangular or hexagonal cross section, although compatible with higher packing densities relative to that of circular cross section photomultiplier tubes, will still nevertheless suffer from edge effects due to the finite sidewall thicknesses of the tubes and other phenomena associated with the periphery of the faceplate and photocathode. For example, FIG. 4A shows a top plan view of an array (402) comprised of photomultiplier tubes (404) with hexagonal cross-sections. Conventional photomultiplier tubes will be characterized by a photosensitive area (406) of approximately spatially uniform response that is less than the total front face area of the photomultiplier tube. A schematic plot of localized response, analogous to that of FIG. 3B, along a section B–B' of the array of FIG. 4A is shown in FIG. 4B. As indicated in FIG. 4B, reduction or distortion of response is typical as the light beam probe is scanned between adjacent photomultiplier tubes. This feature can be problematic for imaging applications as it represents a significant—although predictable and spatially-regular —loss of signal information.

The foregoing considerations of edge effects and their impact on photomultiplier tube imaging arrays are relevant to many types of photomultiplier tubes. Photomultiplier tubes generally have several common features including a photocathode, several dynodes or microchannel plates, and one or more anodes, all of which are enclosed in a sealed, evacuated tube. There are a wide variety photomultiplier designs specifying various electrode configurations including multiple anodes and microchannel plate(s). A review of the prior art will center on aspects of photomultiplier tubes that are germane to the present invention and which relate to the geometry and method of making a seal between the glass faceplate and metal tube. It will be understood that the present invention is applicable to the wide assortment of photomultiplier tubes that share this metal tube-glass faceplate junction, which includes most head-on type, metal tube photomultipliers, irrespective of the number, type or arrangement of the internal electrodes.

The present invention can be better understood if the details of photomultiplier tube structure and assembly are appreciated. Photomultiplier tubes constructed in the head-on type configuration consist, in part, of a glass faceplate coated with a photosensitive material which constitutes the photocathode or light-sensitive element of the device. The faceplate is sealed to one end of a metal tube that is typically rectangular in cross section. The other end of the tube is sealed with a machined metal stemplate. In practice, and often to some advantage, the photocathode coating may cover other interior surfaces of the photomultiplier tube enclosure, including the inner surface of the metal tube to which the faceplate is attached, thus extending its effective area beyond the exposed interior side of the faceplate. The sealed tube forms an enclosure containing the photocathode (s), anode(s), and dynode(s) or microchannel plate(s) of the device. The photoelectric and photomultiplier effects, upon which operation of the device is based, require the interior space of the device be maintained at a sub-atmospheric (vacuum) pressure. Therefore, the integrity of the junction between the glass faceplate and metal tube must be such that a sufficiently air-tight seal is attained and persists throughout the operating life of the device. The effectiveness of the seal between the glass faceplate and metal tube depends on the geometric details of the areas where the metal and glass make intimate contact. The seal geometry also impacts the ease of manufacture of the photomultiplier tube.

A general objective of optical detector design is a device that generates an output signal utilizing as much of the incident radiation of interest as possible. To this end, radiation which has been focused, collimated, or otherwise collected from the field of view of the detector needs to be efficiently coupled to the photosensitive component of the detector. In the case of a photomultiplier, the photosensitive element is the photocathode. Thus, any radiation incident on the photomultiplier that is not coupled to the photocathode constitutes a loss in performance of the photomultiplier tube. Invariably, some of the available light is lost due to reflection, absorption, and shading effects inherent in the geometry of the detector, and thus, the optical collection efficiency is less than perfect.

Therefore, an object of photomultiplier tube design and construction is to maximize the anode current response to incident photons, while maintaining spatial uniformity of response over as large an area as possible, and without degrading the signal-to-noise ratio. In this regard, the present invention pertains to the periphery of the front face of the photomultiplier tube, where the glass faceplate and metal tube seal is made. This edge region detracts from the response, in that light incident on this area is neither efficiently nor uniformly directed onto the photocathode. Moreover, multiplication effects for secondary electron cascades initiated by photoelectrons emitted from the peripheral regions of the photocathode may be different than multiplication effects initiated by electrons stimulated by light incident on the central area of the faceplate. Because of these edge effects, either by themselves or in combination, photomultiplier tube imaging arrays will be plagued by areas of deficient or non-uniform response, thus distorting the image.

The present invention may be regarded as a solution to a general problem encountered in the design, construction, and application of photomultiplier tubes. This problem is the result of certain geometric features of photomultiplier tubes that are consequences of the way the glass faceplate is positioned with respect to the metal tube that houses the electrodes and forms the vacuum enclosure when sealed at the front end with the faceplate and opposite end with the stem plate. Commonly practiced arrangements of the faceplate and tube tend to result in portions of the device that subtend the incident illumination but which do not efficiently couple incident radiation to the photocathode.

FIGS. 5A, 5B, 5C, and 5D show various known arrangements of forming a contact between the metal tube and glass faceplate. FIG. 5A shows the photomultiplier metal tube (502) with a metal flange (504) formed at one end and to which the perimeter of the faceplate (506) is mated and sealed to the underside of the flange (504). The faceplate may include a photocathode coating (508) as shown. Similarly, the faceplate (506) can be seated atop the flange (504) as shown in FIG. 5B. The particular embodiment of FIG. 5B may provide more structural stability under vacuum loading. The juxtaposition of faceplate (506), flange (504) and metal tube (502) in FIGS. 5A and 5B provides for an adequate seal between the metal tube and faceplate due to the relatively large metal-to-glass contact area. However, from the perspective of detector performance, this arrangement is encumbered by a considerable amount obscuration. The metal flange (504) blocks a significant portion of the radiation incident on the front surface of the photomultiplier tube, thus subtracting from the active area of the device, and therefore, the light-sensitive area of such a photomultiplier tube can be significantly less than the total or cross-sectional area of the photomultiplier tube.

FIGS. 5C and 5D show arrangements of joining the faceplate (506) and metal tube (502) that are designed for reducing losses in response associated with the edge effects inherent in the photomultiplier tube geometry described with respect to FIGS. 5A and 5B, primarily by way of eliminating the flange element (504). In FIG. 5C, the side edge of the faceplate (506) makes contact with the inside wall of the metal tube (502). Relative to the arrangement of faceplate and tube shown in FIG. 5A or 5B, the design of FIG. 5C allows more of the photocathode (508) to be exposed to incident radiation. In FIG. 5D, the perimeter region (510) of the faceplate (506) sits atop the metal tube (502). Again, relative to the arrangement of faceplate and tube shown in FIGS. 5A or 5B, the design of FIG. 5D allows more of the photocathode (508) to be exposed to incident radiation.

While the designs depicted in FIGS. 5C and 5D reduce the diminished response of the edge regions, they are not conducive to making an air-tight seal between the glass front plate and metal tube due to the relatively small contact area between these two parts.

European Patent Publication EPA 1 282 150 A1 (Shimoi) describes a design and method of sealing the frontplate to metal tube in photomultiplier tubes that is intended to partially reduce such edge effects while providing an acceptable seal between the metal tube and glass faceplate. Shimoi offers several variations of sealing the photomultiplier tube by embedding the edges of the metal tube into the glass faceplate. For example, FIG. 6, based on a description of Shimoi, shows the ends of the metal tube (602) are tapered to form a knife-edge termination (604). The edges of the metal tube so formed are heated by radio-frequency (RF) heating and are then aligned with and impressed into the glass faceplate (606), which fuses at the point of contact with the metal edge due to the elevated temperature of the metal. The metal tube edge (604) can then be wedged into the softened glass faceplate (606), which then hardens upon cooling, causing a fusion bond between the glass and metal. The embedded metal tube in the glass faceplate makes a good, reliable air-tight seal. A photocathode (608) is formed on the interior side of the faceplate (606) as described in the previous examples. The degree to which the photocathode (608) is still obscured by this design depends on certain specific details of the process.

The specification and drawings of Shimoi indicate that as a result of the fusion process, a bulge (610) forms that protrudes from the edge of the faceplate side as shown in FIG. 6. The presence of such a bulge subverts, at least somewhat, one of the objectives of the invention of Shimoi, because it impedes intimate contact between adjacent photomultiplier tubes when they arranged in a close-packed configuration of an array. It is also evident that the response associated with the periphery (612) of the photomultiplier tube will still be diminished or distorted, in part due to the bulge that forms from the metal tube-faceplate sealing process. Thus, the embodiments of Shimoi do not completely eliminate edge effects on photomultiplier tube response, nor do they allow near-maximum close packing densities in photomultiplier tube arrays.

OBJECTS OF THE INVENTION

It is an object of the present invention to utilize a photomultiplier tube geometry which avoids or effectively eliminates extraneous structural features that preclude a high packing density in photomultiplier arrays, or otherwise create areas within the array with diminished or distorted response.

It is a further object to incorporate into a photomultiplier tube a faceplate with tapered edges that collects light from an area that is at least as large, or larger, than the cross-sectional area of the tube component of the photomultiplier tube, and that efficiently couples said collected light to the photocathode.

Another object of the invention is to form the contact between the metal tube and the faceplate on the underside of the faceplate, such that the tube sidewall does not directly obscure the optical path between incident radiation on the faceplate and the photocathode located inside the photomultiplier tube.

It is a further object of the invention to taper the edges of the photomultiplier faceplate to a degree so that bulges, protrusions, or other imperfections in the glass material resulting from the heating process used to seal the glass faceplate to the metal tube do not prevent intimate contact or otherwise create gaps between adjacent photomultiplier tubes, as when several photomultipliers are packed side-by-side in an imaging array.

Another object of the invention is to shape the edges of the photomultiplier faceplate and arrange the metal-to-glass seal between the metal tube and faceplate such that reductions, distortions, or other perturbations in the photomultiplier tube response from radiation incident near the periphery of the faceplate are such that these edge effects on response can be corrected and/or compensated for by image processing algorithms.

Still another object of the invention is to utilize photomultiplier tube components with shapes and dimensions that are compatible with and conducive to simple and reliable air-tight seals between the metal tube and glass faceplate.

Another object of the invention is a photomultiplier tube structure and method of assembly that permits the use of either a molten solder seal or thermocompression bond, and that is also compatible with forming the photocathode coating on the faceplate prior to mating and sealing the stemplate to the tube, and thereby avoiding a welding step on a photomultiplier workpiece that contains the photocathode. This stipulation is to avoid the potentially damaging or degrading effects of welding on the photocathode or other electrodes of the photomultiplier tube, due to the relatively high-temperatures or vapor emissions associated with welding processes.

SUMMARY OF THE INVENTION

The present invention relates to photomultiplier tubes that are comprised of a glass faceplate sealed to a metal tube, and to design and methods of fabrication of such photomultiplier tubes that enhance their performance, especially in imaging arrays. More particularly, the present invention describes photomultiplier tubes with more spatially uniform response to radiation, including response to radiation incident upon, or in the vicinity of the edge regions of the faceplate and periphery of the photomultiplier tube. The invention improves the utilization of photomultiplier tubes in imaging arrays by reducing gaps between adjacent photomultiplier tubes, and increasing the collection of radiation from or around the areas of contact between adjacent photomultiplier tubes.

The response of a photomultiplier tube depends on the optical collection efficiency of its photocathode and electron multiplication processes associated with other electrodes. The optical collection efficiency of the photocathode serves as a figure of merit to assess particular aspects of the design and performance of photomultiplier tubes. In general, a photomultiplier tube subtends some defined area of the radiation field to which it is exposed. A fraction of photons that are incident on said area is transmitted to the radiation-sensitive photocathode, where an electrical response is initiated. This fraction of photons may be considered the collection efficiency for incident radiation. The collection efficiency will be less than perfect due to reflection, absorption, or any obscuration of the optical path between the radiation source and the photocathode. In conventional photomultiplier tubes the device periphery, i.e., the edge regions of the tube front face, typically exhibits diminished or distorted response to incident radiation due to certain geometric effects engendered by the method of assembly, and especially by the method of sealing the glass faceplate to the metal tube. The present invention addresses such collection efficiency losses associated with the perimeter of the photomultiplier tube. Broadly, the present invention reduces losses in optical collection efficiency by eliminating structural features that obscure the optical path between the faceplate and photocathode and by incorporating features that enhance optical coupling of incident light to the photocathode. Further, the present invention provides a photomultiplier structure that minimizes the intervening gaps between adjacent photomultiplier tubes when the photomultiplier tubes are tightly packed side-by-side in arrays.

More specifically, the present invention utilizes a distinct tapered-edge geometry for the glass faceplate, and makes an air-tight seal at the junction between the glass faceplate and metal tube on the underside of the faceplate. In addition to avoiding obscuration of incident radiation, the shape of the faceplate, in combination with reflective layers or surfaces, creates a light trapping effect that serves to couple light incident at the edge of the faceplate to the photocathode. By such a combination of tapering the edges of the glass faceplate so that the edge sides are oblique with respect to the plane of the faceplate, restricting the metal tube-to-glass faceplate seal to the underside of the faceplate, and optionally applying a reflective coating to the oblique sidewall of the glass faceplate (or else relying on an inherent refractive index change) to effect light trapping, the edge effects encountered in conventional photomultiplier tubes that distort or diminish response, can be mitigated.

DETAILED DESCRIPTION OF THE INVENTION

The invention has utility for many types of photomultiplier tube configurations, but especially those of the head-on type constructed with a metal tube. Common to the present invention and other head-on types of photomultiplier tube, is a metal tube which is fitted with a transparent or semi-transparent faceplate typically made from glass. The faceplate forms an airtight seal with the metal tube to which the faceplate is joined, in order to maintain the sub-atmospheric (vacuum) pressure conditions needed for photoelectron and secondary electron effects upon which operation of the device is based. More importantly, the glass faceplate serves as a window, permitting external radiation to enter the vacuum enclosure created by the sealed tube. Preferably, the interior side of the glass faceplate is coated with a photosensitive material to function as a photocathode. Portions of the photocathode coating may extend to and include the metal tube interior sidewalls. Alternatively, the photocathode may be an electrode element separate from the faceplate and positioned in the interior of evacuated enclosure. The metal tube is sealed at the bottom with a stemplate, through which electrode connections are made and in which a port may be provided for evacuation of the tube by pumping. The stemplate port can also be used to introduce vapors which condense on the inner surfaces of the tube, providing a means to deposit coatings or chemically modify existing coatings or surfaces in the interior of the vacuum enclosure. In this way, the photocathode can be formed after the photomultiplier tube is assembled and sealed.

The present invention diverges from the prior art with regard to the shape of the glass faceplate, its positioning with respect to the metal tube, the method of sealing the faceplate to the metal tube, and in the utilization of reflective surfaces on the edge(s) of the faceplate to enhance collection efficiency from the periphery of the faceplate. Conventional methods of making the seal between the glass faceplate and metal tube, and structural features engendered by using such methods, tend to detract from the collection efficiency, spatial uniformity of response, and packing density of the photomultiplier tube. Many such types of photomultiplier tubes can readily incorporate and benefit from the designs, materials of construction, and fabrication methods taught here. A particular aspect of the present invention relevant to arrays is that it permits closer side-by-side contact of adjacent photomultiplier tubes than many embodiments of the art.

PREFERRED EMBODIMENT

Figure 6:
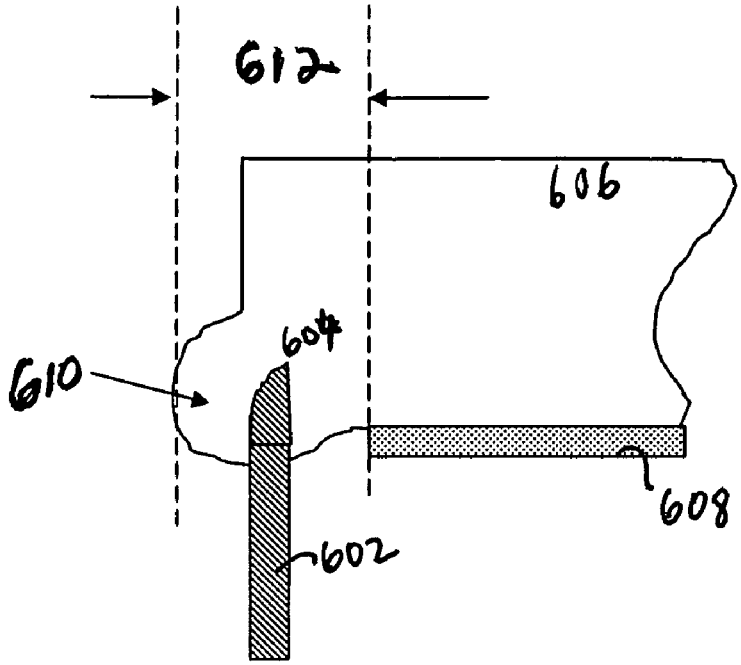
FIG. 6 Prior Art
FIG. 6 is a side view in partial section showing the manner of sealing the faceplate to the metal tube in the photomultipier tube described in European Patent Publication EP 1 282 150 A1.
Figure 7:
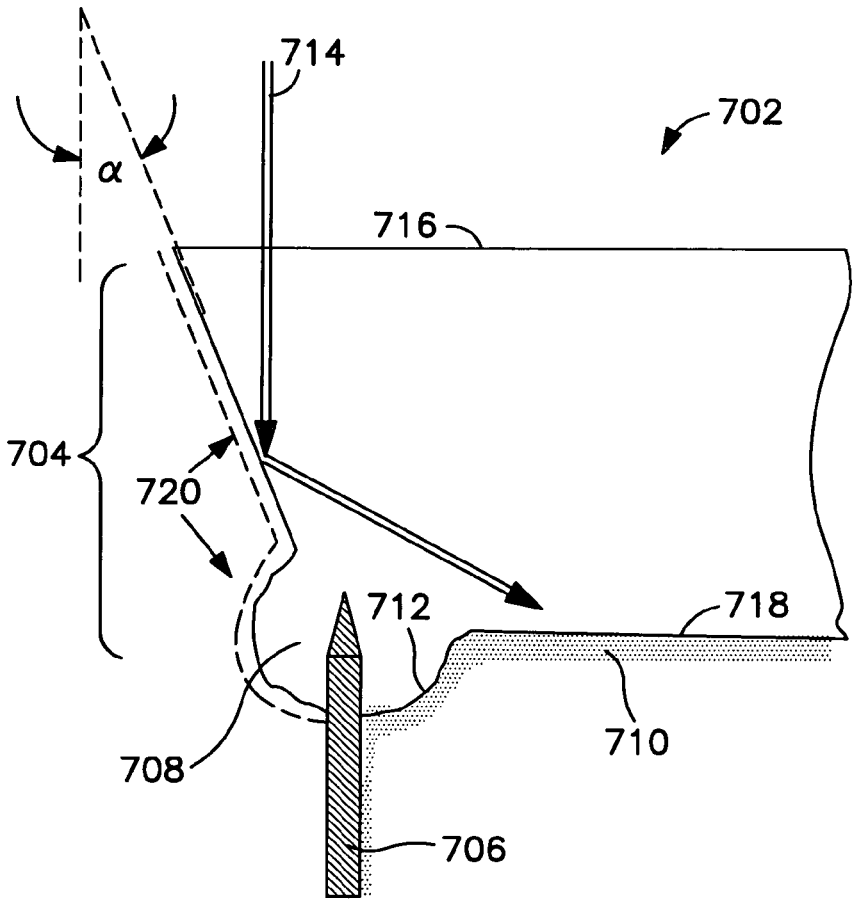
FIG. 7 is a side view in partial section of the photomultiplier tube in accordance with the present invention and which includes a ray tracing representative of radiation incident on the periphery of the face plate and reflected to impinge on the photocathode.

The present invention specifies the faceplate to be made with tapered edges. FIG. 7 shows a side view of the faceplate (702) with a beveled sidewall (704), and the edges of the metal tube (706) embedded in the underside of the faceplate (702). The sidewall (704) of the faceplate (702) is inclined at an angle $\alpha$ to a normal of the plane of the faceplate, as indicated in FIG. 7. A bulge (708) in the glass faceplate from the process used to seal the metal tube to the faceplate is evident, similar to that discussed with respect to FIG. 6. A photocathode (710) is formed as a coating of photoemissive material on the underside of the faceplate (702). It is noted that the photocathode coating, deposited conformally by condensation of vapor-phase chemical constituents, will in general cover portions (712) of the bulge surface exposed to the interior of the tube, and will typically extend to the metal tube (706) inner surface. This feature is generally beneficial as it improves the photocathode optical collection efficiency, especially from edge regions. Moreover, in some preferred embodiments of the invention, electrical continuity between the photocathode and the conductive metal tube, such as realized by the photocathode coating contacting portions the metal tube as shown in FIG. 7, provides a means of electrically biasing the photocathode. For example, the photocathode (710) can be set at ground potential if it makes physical contact with the metal tube which too is maintained at ground potential. If, on the other hand, the photocathode is to be operated at a negative potential with respect to ground, the metal tube can be accordingly biased at said negative potential. In this case, it is advisable to coat the outer surfaces of the metal tube with an insulating layer for purposes of electrical isolation, noise reduction, and safety.

Incident radiation (714) impinges on the top surface (716) of the faceplate (702) which is larger in area than the underside surface (718) of the faceplate on account of its trapezoidal cross-section. For the case of an incident ray denoted as 714, the light is reflected from the sidewall and eventually impinges the photocathode. It is noted that a similarly disposed light ray near the edge of the faceplate for a photomultiplier configured according to the prior art as described with respect to FIG. 6 would generally not be efficiently coupled to the photocathode. Incident light rays such as 714 that impinge on the sidewall at an angle of incidence $\theta$, where $\theta$ equal to 90° minus $\alpha$, as denoted in FIG. 7, will generally be reflected from the sidewall (704) and directed toward the photocathode (710). Light rays for which the angle $\theta$ of incidence exceeds the critical angle $\theta_c$ of the faceplate glass will be so reflected. The critical angle $\theta_c$ is given by the arcsin(1/n) where n is the refractive index of the faceplate glass. This internal reflection thus provides a means for detecting light incident near the edges of the faceplate. In some case, the light may even undergo multiple internal reflections that include internal reflections from the top surface 716 of the faceplate which ideally terminate in absorption in the photocathode. To facilitate such internal reflection, a reflective coating (720), such as a gold or aluminum film, can be deposited on the oblique sidewall (704) of the faceplate, in which reflection from the sidewall is achieved for practically all incident angles $\theta$.

Figure 8A:
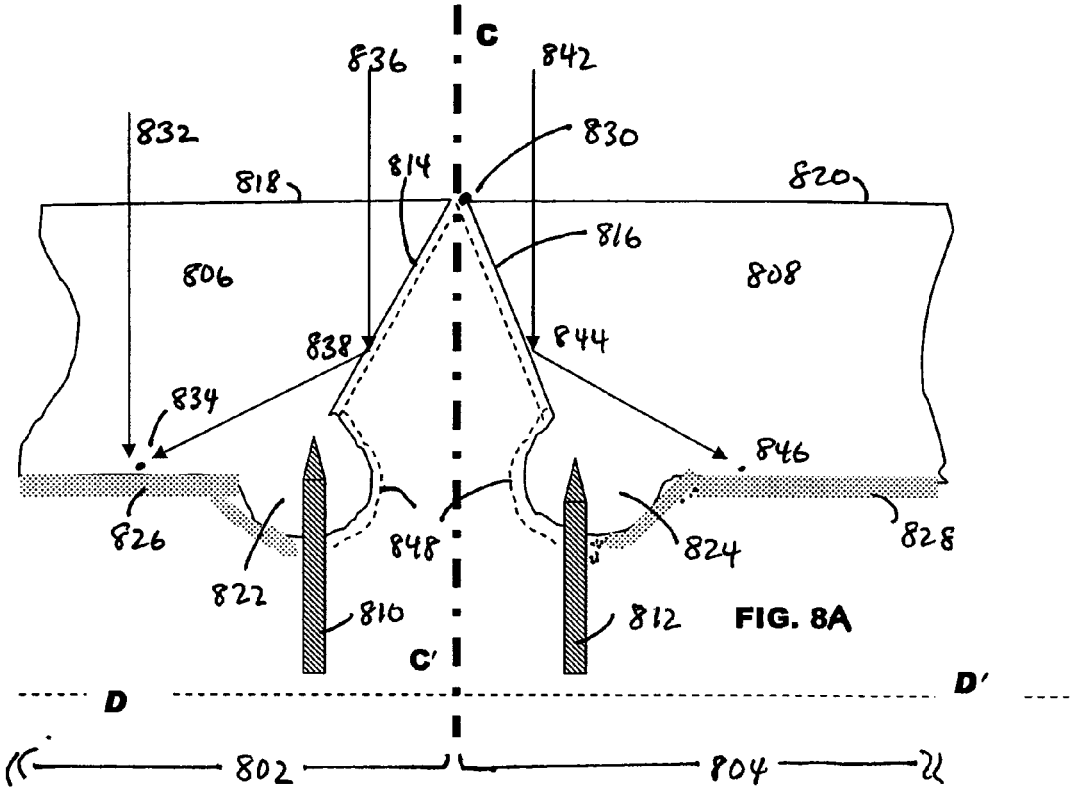
FIG. 8A is a side view in partial section showing two adjacent photomultiplier tubes according to the present invention, including representative ray tracings of radiation incident near the areas of contact of the adjacent photomultiplier tube.

The advantage of the present invention for photomultiplier tubes assembled into imaging array can be understood by referring to FIG. 8A, which shows a cross-sectional view of two adjacent photomultiplier tubes (802, 804) in close contact along a section C–C' between the two adjacent photomultiplier tubes. The photomultiplier tubes have the same features as described with respect to FIG. 7.

Figure 1:
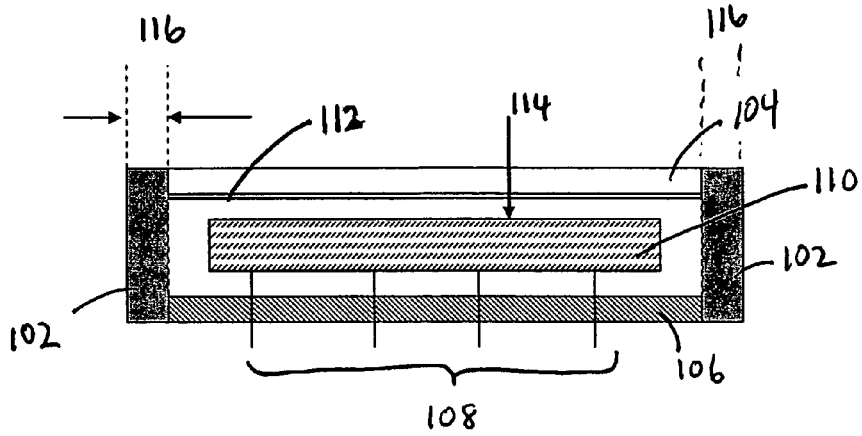
FIG. 1 is a generalized schematic of a front-end type, metal tube photomultiplier.
Figure 2A:
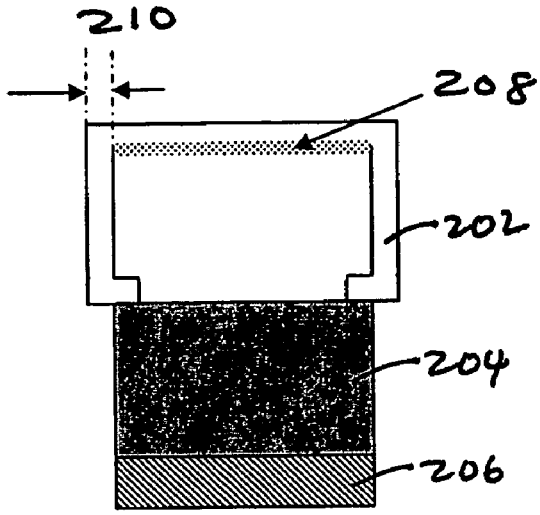
FIG. 2A Prior Art
FIG. 2A is a side view of a photomultiplier tube constructed by mounting a shaped glass envelope on a metal tube.
Figure 2B:
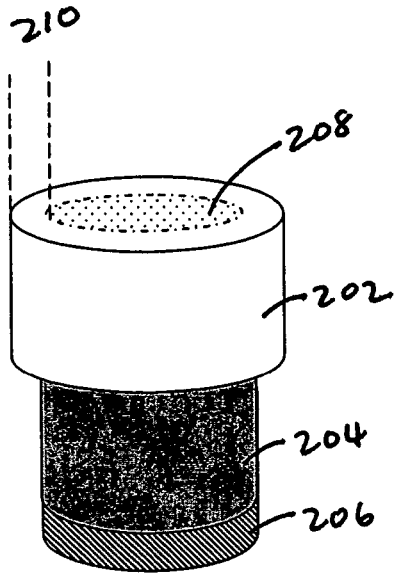
FIG. 2B Prior Art
FIG. 2B is a perspective view of the photomultiplier tube shown in FIG. 3A.
Figure 3A:
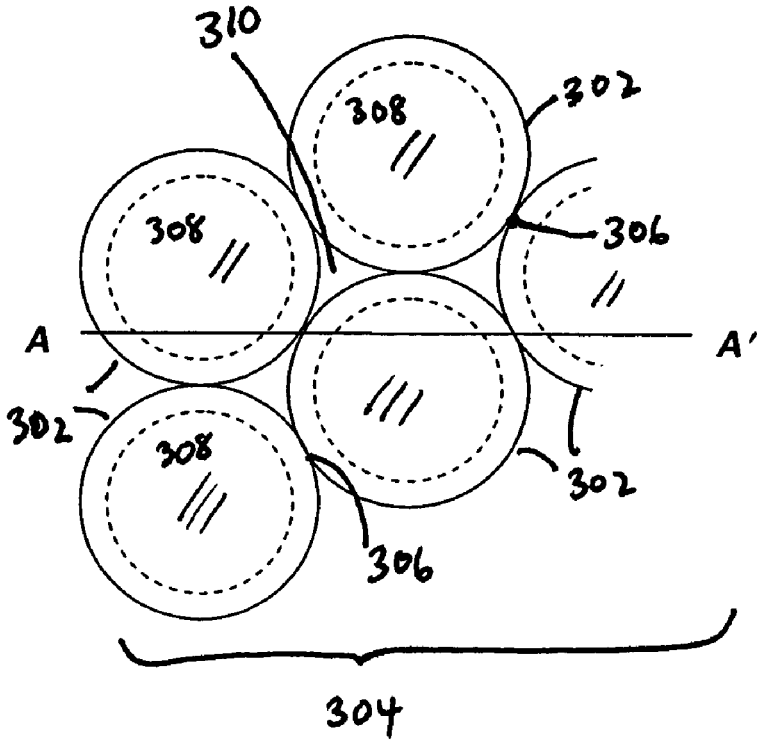
FIG. 3A Prior Art
FIG. 3A is a partial top plan view of an array of photomultiplier tubes having circular cross sections.
Figure 3B:
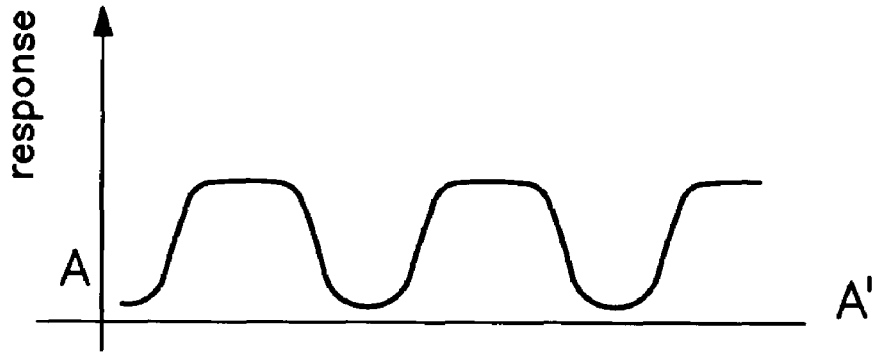
FIG. 3B PRIOR ART
FIG. 3B is a graph of a response plot of the photomultiplier array of FIG. 3A for radiation incident along line A–A' in FIG. 3A.
Figure 4A:
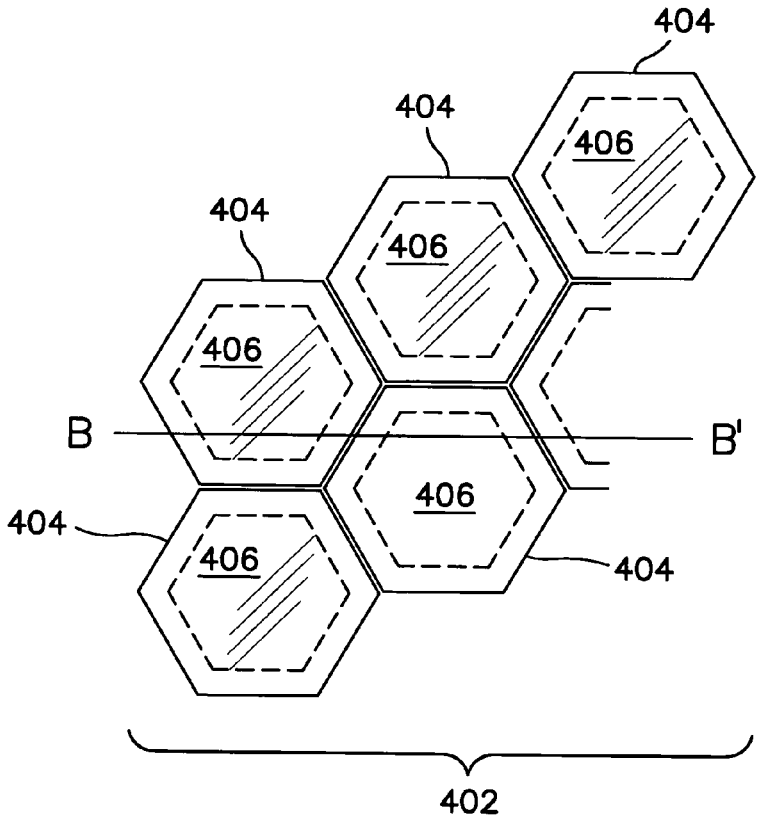
FIG. 4A PRIOR ART
FIG. 4A is a partial plan view of an array of photomultiplier tubes having hexagonal cross sections.
Figure 4B:
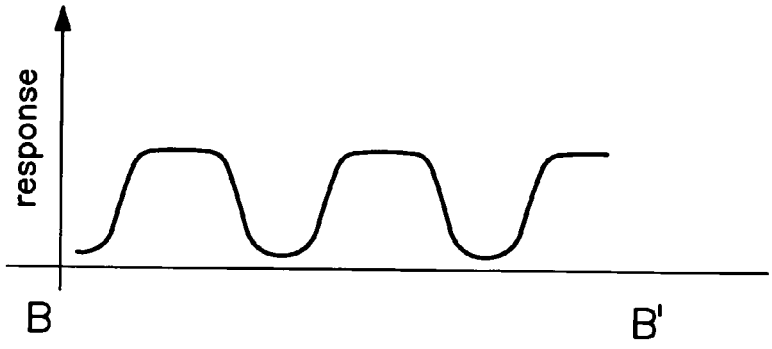
FIG. 4B PRIOR ART
FIG. 4B is a graph of a response plot of the photomultiplier array of FIG. 4A for radiation incident along line B–B' in FIG. 4A.
Figure 5A:
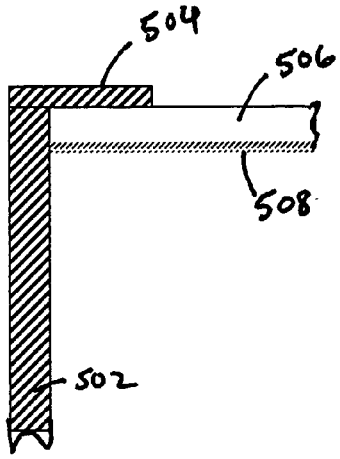
FIG. 5A is a side view in partial section showing a first geometry for the junction between the metal tube and glass faceplate of a photomultiplier tube.
Figure 5B:
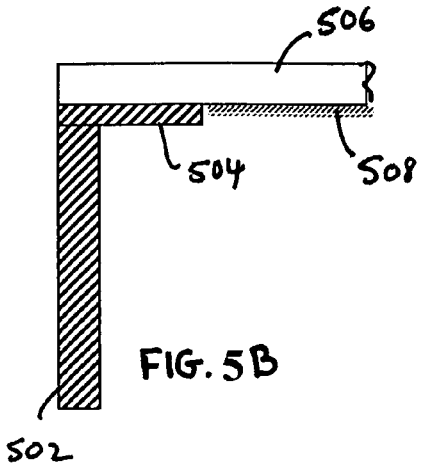
FIG. 5B is a side view in partial section showing a second geometry for the junction between the metal tube and glass faceplate of a photomultiplier tube.
Figure 5C:
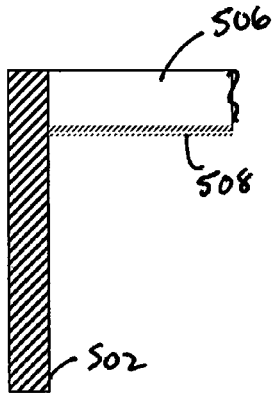
FIG. 5C is a side view in partial section showing a third geometry for the junction between the metal tube and glass faceplate of a photomultiplier tube.
Figure 5D:
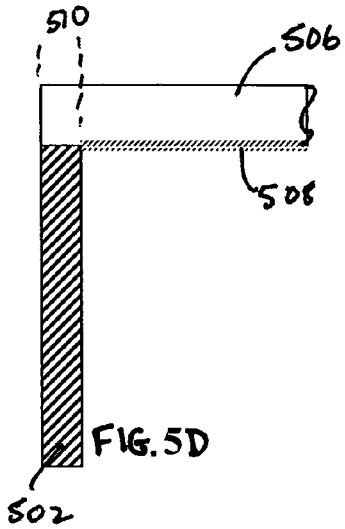
FIG. 5D Prior Art
FIG. 5D is a side view in partial section showing a fourth geometry for the junction between the metal tube and glass faceplate of a photomultiplier tube.
Figure 8B:
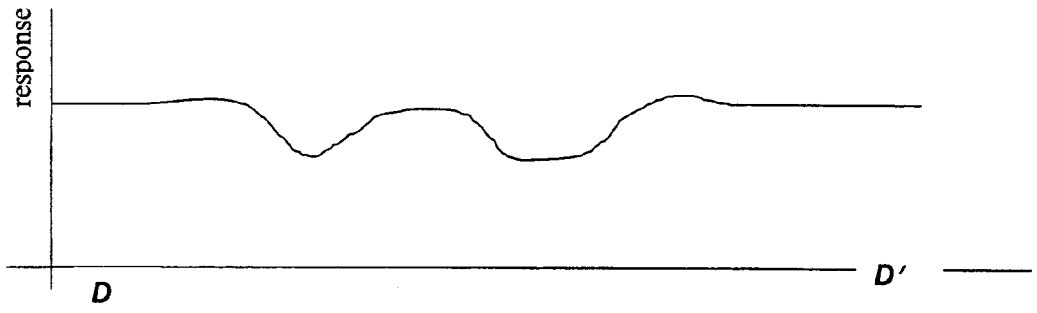
FIG. 8B is a graph of the response plot of photomultiplier tubes shown in FIG. 8A.

FIG. 8B shows a schematic of a response curve along a section D–D' of adjacent photomultiplier tubes shown in cross-section in FIG. 8A, and indicates the response is enhanced for the areas between two adjacent photomultiplier tubes, compared to that exhibited by close-packed arrays of conventional photomultiplier tube geometries such as shown in FIGS. 4A. In FIG. 8A, two photomultiplier tubes (802, 804) with respective face plates 806, 808; respective metal tubes 810, 812; respective tapered sidewalls 814, 816; respective faceplate top surfaces 818, 820; respective sealing bulges 822, 824; and respective photocathodes 826, 828 make contact at a point 830 along the perimeters of the respective top surfaces (818 and 820) of the faceplates (806, 808). The tapered sidewalls (814, 816) of the faceplates (806, 808) are coated with reflective material (848). The sealing bulges (822, 824) that result from the fused contact with the embedded edges of the metal tubes (810, 812) do not limit close contact of the adjacent photomultiplier tubes (802, 804).

Illustrative ray tracings, representative of radiation incident upon different points on the faceplate are shown. For example, Ray 832 is incident on the faceplate top surface 818 and is transmitted directly to the photocathode (826) at point 834 by way of an unobstructed path. Ray 836 is incident on faceplate top surface 818 near its edge. Ray 836 is reflected at point 838 from tapered sidewall (814) as shown, and impinges on the photocathode (826) at point 834. The optical path of ray 836 demonstrates that, with the present design, incident radiation near the periphery of the photomultiplier will still be transmitted to the photocathode. Similar considerations apply to rays incident upon the top surface (820) of the adjacent photomultiplier tube (804). For instance, ray 842 is reflected from the sidewall (816) at point 844 and impinging on photocathode (828) at point 846. As mentioned, the reflection of light from the sidewalls (814, 816) is effected due to the refractive index difference between the faceplate (806, 808) and air, or more preferably, can be enhanced by application of a reflective coating (848) to the sidewalls (814, 816). The reflective coating can be a shiny metal such as gold, aluminum, or silver, or a other materials such as oxide compounds and the like.

A schematic plot of anode current response as a function of position of the incident radiation along any section, say D–D', of the array depicted in FIG. 8A is given in FIG. 8B. The plot indicates that while an appreciable signal may be obtained for radiation incident in or near the interface of two adjacent photomultiplier tubes, it is nevertheless distorted relative to the signal generated by light incident near central region of the faceplate. This complicating effect is considered preferable to a complete loss of signal from the radiation incident on peripheral areas of the photomultiplier tubes, as it can be corrected or compensated for by image processing algorithms that are well known in the art and routinely used to correct for defects and anomalies in imaging devices. In this way, the losses in photomultiplier response that are broadly characterized as "edge effects", can be avoided or ameliorated by incorporating geometric designs and optical features that trap radiation incident upon periphery of the photomultiplier and direct said radiation to impinge on the photocathode.

The present invention represents a significant improvement over conventional photomultiplier tubes in that the effective responsive area is significantly increased. Further, sidewall protrusions or obstructions that interfere with close packing of adjacent photomultiplier tubes in an imaging array are avoided. Photomultiplier tubes constructed according to the present invention can make intimate contact with adjacent tubes, thus drastically reducing gaps between adjacent photomultiplier tubes.

Some distortion of the signal is inevitable for incident radiation on peripheral areas of the photomultiplier tube and in the intervening areas between adjacent photomultiplier tubes in an array. Although in the present design the radiation incident on the periphery of a photomultiplier tube is still substantially collected by the photocathode, it will in all likelihood produce a distorted anode current signal relative to similar radiation impinging on the center of the faceplate of the photomultiplier tube. A comparative advantage of the present invention over conventional photomultiplier tubes is predicated on the notion that distortion of part of the image signal is preferable to losing part of the image signal, as algorithms can correct or compensate for distortions, but cannot replace information lost in an absent signal.

PREFERRED METHOD OF FABRICATION

The photomultiplier tube design of the present invention is compatible with at least several established methods of photomultiplier tube fabrication. As shown in FIG. 7, a glass faceplate (702) is shaped and its edges, e.g., 704, are beveled using glass cutting, grinding, and polishing operations as are well-known in the art. The best sidewall angle $\alpha$, defined in FIG. 7, will vary according to the size of the bulge and thickness of the metal tube walls. The metal tube (706) can be made of several types of metals including, for example, stainless steel or Kovar®. The tube can be heated by a number of techniques including radio-frequency (RF) heating. The heated edges of the metal tube, which are feathered to reduce thermal stress effects, are impressed into the glass. The metal edges of the heated tube sufficiently soften the glass at points of contact with the tube, permitting the metal tube to penetrate into the glass. Upon cooling, the glass solidifies, forming a sufficiently rugged, air-tight seal between glass faceplate and the metal tube with edges embedded in said faceplate. A photocathode coating is deposited on the interior of the faceplate. At this stage of assembly, the designation 'interior' side of the faceplate refers to the side in which the tube is embedded. The faceplate with sealed metal tube are placed in a vacuum coating chamber. Antimony is evaporated on the interior side of the faceplate, coving the faceplate (702) and portions of the inner surfaces of the metal tube. The antimony layer is treated with alkali vapors which creates a photocathode (710) with the desired photoemissive properties. Alternatively, the antimony and alkali can be co-deposited in a vacuum coating step. Thin-film vacuum coating as such can provide for a photocathode that is highly uniform in thickness and photoemissive properties. In a multi-chamber vacuum coating system, the photocathode is deposited in one vacuum chamber, the workpiece, comprised of the glass faceplate sealed to the metal tube and on which the photocathode coating is formed, is then transferred to a second vacuum chamber. A stemplate on which electrodes are mounted, and on which an indium or indium alloy is applied for purposes of making a seal to the metal tube with attached faceplate, is positioned in the second chamber. A manipulator moves the metal tube with attached faceplate, and aligns and mates it with the stemplate, pressing the tube and stemplate together. The indium alloy, if molten, effectively serves to solder the tube to the stemplate. If the indium or indium alloy is solid, a thermocompression bond is made between the stemplate and metal tube. It is noted that as the photomultiplier tube is assembled and sealed in a vacuum chamber, it is not necessary to pump out the photomultiplier tube enclosure after sealing. Further, welding steps to seal the stemplate to the tube are avoided. The high temperatures and vapors associated with welding can degrade the photocathode and other elements of the photomultiplier tube.

Alternative methods of photomultiplier tube manufacture can be considered. These might incorporate a stemplate with orifice port that is provided for connection to a pump in order to evacuate the photomultiplier tube after assembly and sealing (at atmospheric pressure). Such a method often involves welding the stemplate to the tube. This is followed by in-situ formation of the photocathode by heating an antimony pellet evaporation source contained in the photomultiplier tube. In a variation on this method, the photocathode can be deposited before the tube is sealed, or the photocathode can be formed by introducing antimony and alkali vapors through a stemplate port. For several reasons, these alternative methods are considered inferior to the preferred technique described above wherein and with all operations performed in a vacuum chamber, the glass faceplate and metal tube are first joined, the photocathode is then deposited on the faceplate, and the tube with faceplate and photocathode coating is mated and sealed to the stemplate using indium soldering or thermocompression bonding. The drawbacks to these alternative methods of fabrication are as follows. First, welding processes tend to degrade the photocathode and other electrodes. Second, the portion of the antimony pellet remaining after its partial evaporation, and connecting wires used to electrically heat said pellet in order that it evaporates, can perturb electron trajectories in the photomultiplier tube, leading to distortions in spatial response. Moreover, in some photomultiplier tube designs there may not be sufficient space for proper placement of an antimony pellet evaporation source. Third, it is difficult to achieve uniform deposition of the photocathode by introducing vapor substances through a stemplate port due to the obstructions and tortuous paths through of the various electrodes and plates situated between the faceplate and stemplate. The preferred method of fabricating the photomultiplier tube of the present invention obviates the use of such problematic fabrication steps.

It will be recognized by those skilled in the art that changes or modifications may be made to the above-described invention without departing from the broad inventive concepts of this invention. It is understood, therefore, that the invention is not limited to the particular embodiments disclosed herein, but is intended to cover all modifications and changes which are within the scope of the invention as defined in the appended claims.

We claim:

1. A photomultiplier tube comprising:

a metal tube having a first end and a second end;

a faceplate attached to said metal tube at the first end thereof; and a stem plate attached to the second end of said metal tube, wherein the faceplate has an outer surface, an inner surface, and a sidewall disposed between the outer and inner surfaces, said outer surface having an area that is greater than an area of the inner surface, whereby the sidewall extends between the inner and outer surfaces at an acute angle relative to a line that is normal to the outer surface, said acute angle being dimensioned such that the outer surface of said faceplate overhangs a bulge in the faceplate that results from attachment of said metal tube to the faceplate.

2. A photomultiplier tube as set forth in claim 1 comprising a photocathode formed on the inner surface of said faceplate.

3. The photomultiplier tube of claim 1 comprising a photocathode formed on the inner surface of said faceplate and on an interior surface of said photomultiplier tube.

4. A photomultiplier tube as set forth in claim 1 wherein the first end of said metal tube comprises a feathered edge.

5. A photomultiplier tube as set forth in claim 1 wherein the sidewall of said faceplate comprises a reflective surface.

6. A photomultiplier tube as set forth in claim 5 wherein the reflective surface comprises a reflective coating formed on the sidewall of said faceplate.

7. An imaging device comprising an array of photomultiplier tubes arranged in abutting relationship, wherein each photomultiplier tube comprises:

a metal tube having a first end and a second end;

a faceplate attached to said metal tube at the first end thereof; and a stem plate attached to the second end of said metal tube, wherein the faceplate has an outer surface, an inner surface, and a sidewall disposed between the outer and inner surfaces, said outer surface having an area that is greater than an area of the inner surface, whereby the sidewall extends between the inner and outer surfaces at an acute angle relative to a line that is normal to the outer surface, said acute angle being dimensioned such that the outer surface of said faceplate overhangs a bulge in the faceplate that results from attachment of said metal tube to the faceplate.

8. An imaging device as set forth in claim 7 wherein each photomultiplier tube comprises a photocathode formed on the inner surface of said faceplate.

9. The imaging device of claim 8 wherein each photomultiplier tube comprises a photocathode formed on the inner surface of said faceplate and on an interior surface of said photomultiplier tube.

10. An imaging device as set forth in claim 7 wherein the first end of the metal tube in each of said photomultiplier tubes comprises a feathered edge.

11. An imaging device as set forth in claim 7 wherein the sidewall of the faceplate of each of the photomultiplier tubes comprises a reflective surface.

12. An imaging device as set forth in claim 11 wherein the reflective surface comprises a reflective coating formed on the sidewalls of the faceplates of each of the photomultiplier tubes.

* * * * *